United States Patent [19]

Haage et al.

[11] 4,113,907

[45] * Sep. 12, 1978

[54] FABRIC-REINFORCED SEALING SHEETS

[75] Inventors: Karl Haage, Troisdorf-Spich; Dieter Scharff, Troisdorf-Sieglar, both of Germany

[73] Assignee: Dynamit Nobel Aktiengesellschaft, Germany

[ * ] Notice: The portion of the term of this patent subsequent to Nov. 23, 1993, has been disclaimed.

[21] Appl. No.: 609,944

[22] Filed: Sep. 3, 1975

[30] Foreign Application Priority Data

Sep. 3, 1974 [DE] Fed. Rep. of Germany ..... 2442156

[51] Int. Cl.[2] ..... B32B 5/08; B32B 3/02; E04C 1/00

[52] U.S. Cl. ..... 428/111; 428/193; 428/213; 428/226; 428/228; 428/229; 428/251; 428/252; 428/258; 428/259; 428/921; 52/309.16

[58] Field of Search ..... 428/257, 258, 259, 111, 428/110, 193, 500, 522, 443, 242–249, 251, 225, 226, 232, 213, 228, 229, 252, 921; 427/160, 211, 160, 209; 52/309.15, 309.16

[56] References Cited

U.S. PATENT DOCUMENTS

| | | | |
|---|---|---|---|
| 1,327,281 | 1/1920 | Jenkins | 428/247 X |
| 2,403,617 | 7/1946 | Skeyhan | 428/225 X |
| 2,787,570 | 4/1957 | DeFrestlott et al. | 428/257 X |
| 2,788,052 | 4/1957 | Schulman | 428/443 X |
| 2,836,529 | 5/1958 | Morris | 428/257 X |
| 3,309,220 | 3/1967 | Osken | 427/160 |
| 3,421,971 | 1/1969 | Kamal | 428/515 X |
| 3,429,732 | 2/1969 | Baitinger | 427/160 |
| 3,582,446 | 6/1971 | Stolki | 428/247 |
| 3,597,300 | 8/1971 | Miller | 428/193 |
| 3,992,842 | 11/1976 | Haage et al. | 428/251 |

OTHER PUBLICATIONS

Condensed Chemical Dictionary, 8th Ed. p. 103.

*Primary Examiner*—Ralph S. Kendall
*Attorney, Agent, or Firm*—Craig & Antonelli

[57] ABSTRACT

A fabric-reinforced sealing sheet formed of a synthetic thermoplastic resin suitable for sealing large areas of structures including building constructions, underground constructions and the like by the spot-like or strip-shaped mounting to the structures, which has a reinforcing fabric embedded within a mass of thermoplastic synthetic resin. The fabric is provided at spaced intervals with fabric-reinforcing strips which extend throughout the fabric-reinforced sealing sheet.

18 Claims, 4 Drawing Figures

FIG. 1
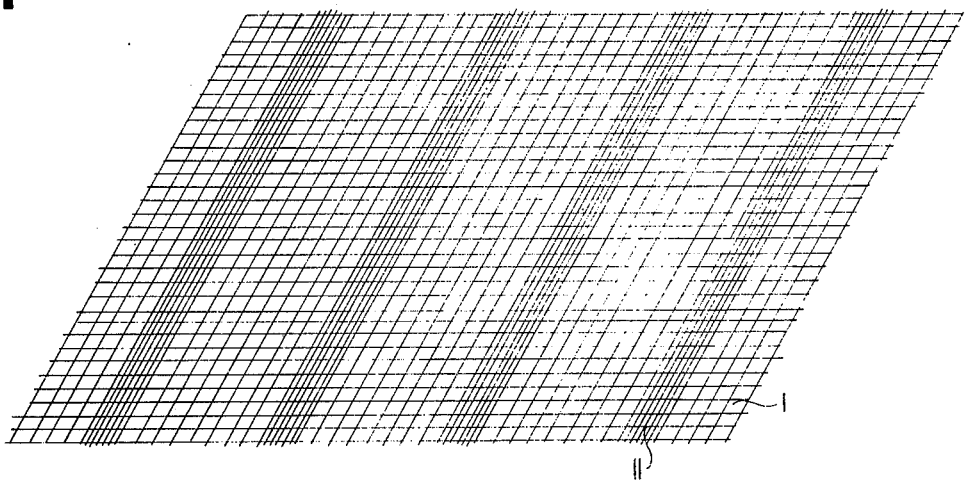
FIG. 2
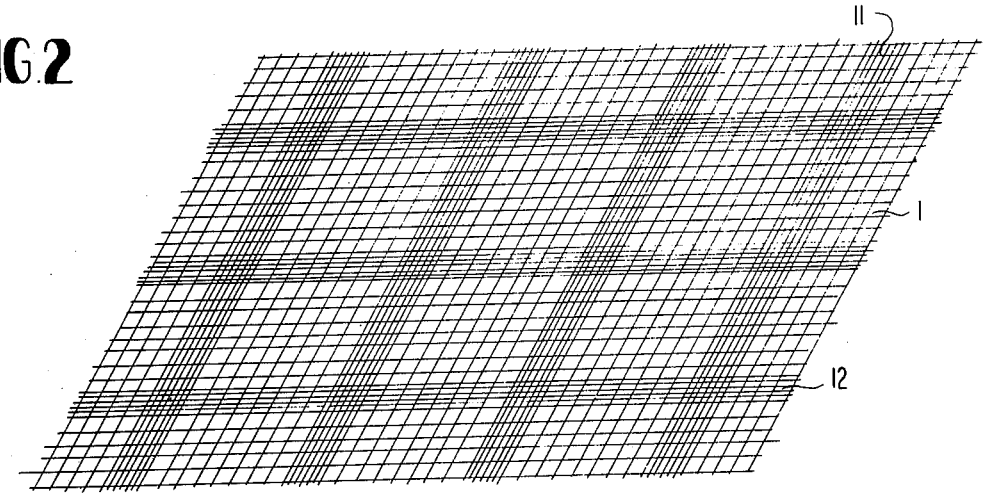
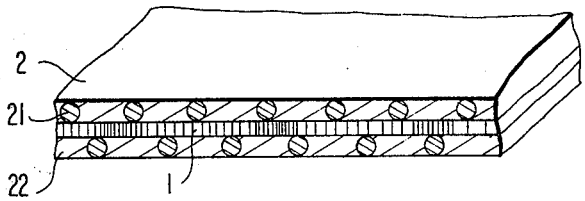
FIG. 3

FABRIC-REINFORCED SEALING SHEETS

The present invention relates to fabric-reinforced sealing sheets, preferably formed of a thermoplastic synthetic resin, for large-area sealing purposes in building construction, underground construction, and civil engineering construction, suitable for a spot-like or strip-shaped mounting to substructures, e.g. buildings and other constructions, and to a process for the manufacture of such a sealing sheet.

In the laying of sealing sheets, on a substrate or the like, especially in the loose laying of such sheets, it is necessary to secure the sheets against lifting off from the substrate, for example due to wind suction or inherent weight. This is accomplished in case of flat roofs, for example, by applying a gravel load, or in slanted roofs and other building structures by means of metallic strips or metallic disks or plates effecting a mechanical connection of the sealing sheet to the roof substructure by means of screws, rivets, or the like.

It is an object of the invention to provide in a particularly advantageous manner sealing sheets useful for loose-laying purposes having reinforcing strips to improve the use of a spot-like or strip-shaped attachment that secures the sheet to a substructure and to provide a high load-bearing capacity.

Consequently, the invention proposes, in connection with sealing sheets made of preferably thermoplastic synthetic resins and having a fabric serving as a reinforcing means, to provide the fabric at intervals with fabric-reinforcing strips extending in one direction or in two mutually perpendicular directions, respectively, embedded within a mass or matrix of thermoplatic synthetic resin. In this way, the objective is attained that the sealing sheet proper includes a load-transferring reinforcement supplementing the mounting system for the mechanical attachment of the sealing sheets to the substructure. It has thus become possible to effect the attachment of the sealing sheets to the substructure, for example, by means of screws or rivets in the zone of these reinforcing strips of the fabric. As a result, the mechanical load-bearing capacity of the sealing sheet is increased in this zone and additionally, as seen in total, the deformations of the loosely laid sealing sheets, for example due to wind suction or inherent weight, are reduced.

In the arrangement of the present invention, the fabric-reinforcing strips can be formed by a denser thread system and/or by thicker threads of the same material or of a material different from the basic material of the fabric. However, it is likewise possible to fashion the fabric-reinforcing strips from separate ribbons or bands of the same material or of a material different from the basic material of the reinforcing fabric. The incorporation of the fabric-reinforcing strips into the fabric is effected during the manufacture of the same reinforcing fabric, for example by incorporation during weaving. Suitable reinforcing fabrics are fabrics of mineral fibers, e.g. glass fibers in the form of endless or staple fibers, or synthetic nettings made from threads of polyester, polyamide, polyethylene, polypropylene, polycarbonate, or the like. The fabric-reinforcing strips can consist of mineral fibers, such as glass fibers, or synthetic threads or ribbons of polyester, polyamide, polyethylene, polypropylene, polycarbonate, or the like, or wires or strips of metal, such as aluminum or steel.

In order to make the position of these fabric reinforcing strips within the reinforcing fabric, which fabric is completely embedded into the thermoplastic sealing sheet, optically visible, the threads of the strips can be fashioned, for example, to be correspondingly thick. However, it is also possible, for example, to prepare the reinforcing strips so that a discoloration of the thermoplastic cover layer occurs in the zone of these reinforcing strips so that, during a subsequent laying step, the mounting of the sealing sheets to the substructure can also be effected in the zone of these reinforcing strips. To make the fabric-reinforced strips on the surface of the sealing sheet visible, it is possible to use dyed reinforcing inserts and/or fibers with a simultaneous translucent character of the cover layer. However, it is likewise possible, for example by the incorporation of metallic wires into the reinforcing strips of the fabric, to subsequently mark the mounting points of the thermoplastic sealing sheet by magnetic control and/or scanning during the subsequent laying operation.

A further development of the thermoplastic sealing sheet of this invention provides that a further insert, e.g. of asbestos fibers or another suitable material is incorporated as a sheet to provide a fire protection layer, in addition to the insert formed by fabric-reinforced strips. Such sealing sheets are especially advantageous for the leakproofing of ungraveled, mono-shell roofs which must be resistant to flying sparks and radiant heat. In this connection, it is advantageous to design the layered system so that, starting with the weather side, the first layer is a thermoplastic material, then follows the flameproofing layer, thereafter the fabric-reinforced layer (including the fabric-reinforcing strips), and then on the underside a further thermoplastic layer.

Since normally the thermoplastic sealing sheets have only one weather-exposed side during their use, it is suggested to fashion the layers enclosing the fabric of a thermoplastic synthetic resin, preferably of soft PVC with a different composition regarding the content of stabilizers and filler. In this way, an economical manufacture of even thicker sealing sheets is made possible. For example, it is suggested to impart to the topside layer of the thermoplastic sealing sheet, facing the exposure side, a higher weatherability than to the layer on the underside by adding stabilizers or other suitable materials. Suitable stabilizers are benzotriazone, benzophenone, or barium-cadmium-zinc complexes.

The production of a fabric-reinforced sealing sheet of soft PVC is accomplished according to this invention preferably by applying a first thermoplastic layer as a soft PVC plastisol to an endless carrier band or belt support at room temperature; placing on this first thermoplastic layer, which is still in the ungelled, i.e. plastic condition, the reinforced fabric and optionally a fire-protecting layer; thereafter initially gelling or curing this layer by a short-term heating step in a temperature range of 160°–200° C., thus accomplishing simultaneously the bonding with the fabric; then applying the second layer as a soft PVC plastisol; and completing the gelling step at a temperature of 160°–250° C.

It is, of course, also possible to manufacture the fabric-reinforced thermoplastic sealing sheet of this invention by extrusion, wherein the layers of fabric are surrounded on all sides by the thermoplastic synthetic resin. Another conventional possibility of producing the sheet resides placing the lower thermoplastic sheet, the fabric-reinforced layer, optionally a fire protection layer, and the topside thermoplastic cover sheet on top of one another and then bonding the layers together, for example, under the effect of heat by welding and/or cementing. Other thermoplastic synthetic resins, e.g. polyisobutylene or elastomers, such as butyl rubber, are likewise suitable for the layers of the sealing sheet.

Differing thicknesses can be provided, as well as different materials and/or material compositions in the production of the fabric-reinforced sealing sheet according to this invention for the upper thermoplastic layer as well as the lower thermoplastic layer. It is also possible to leave a zone free of fabric along the lateral margins of the sealing sheets.

The invention is illustrated by embodiments in the drawings and will be explained in greater detail below with reference thereto. In the drawings:

FIG. 1 shows the reinforcing fabric with reinforcing strips extending in one direction; FIG. 2 shows the reinforcing fabric with intersecting reinforcing strips;

FIG. 3 shows a cross section through a fabric-reinforced thermoplastic sealing sheet;

Figure 4:
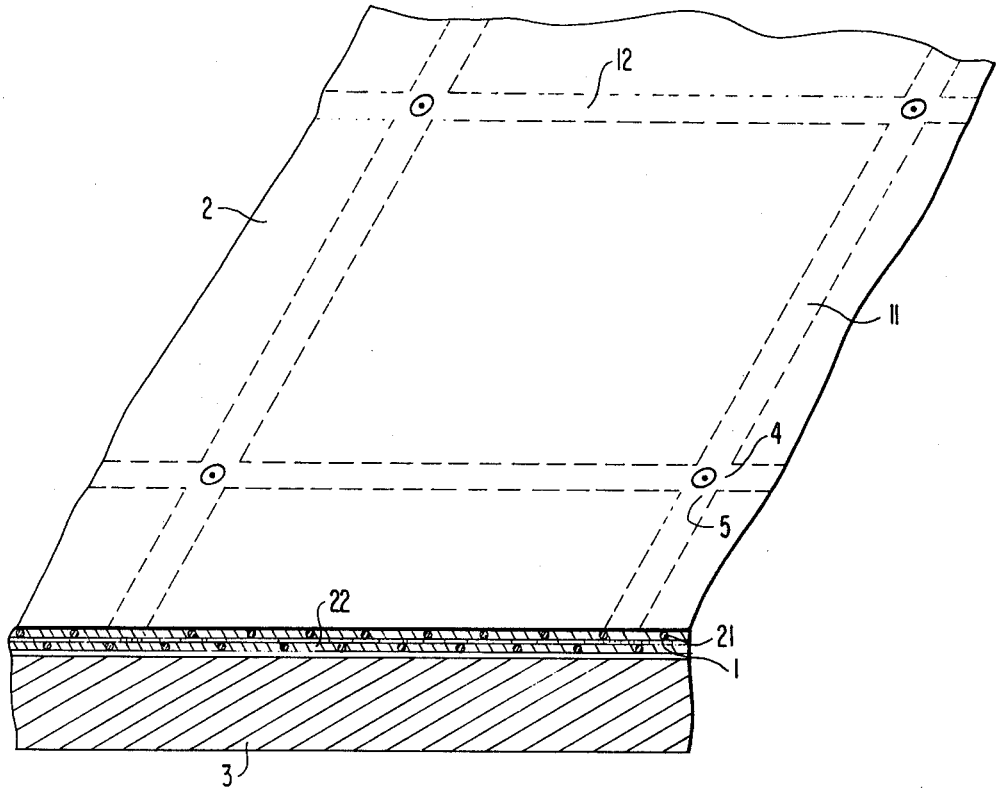
FIG. 4 shows the sealing, i.e. leakproofing of a roof by means of the fabric-reinforced sealing sheet according to FIG. 3.

The lattice-like fabric 1 according to FIG. 1 is provided at intervals with reinforcing strips 11 extending in one direction.

This fabric serves as an insert for a fabric-reinforced thermoplastic sealing sheet wherein the fabric 1 is covered with a layer of synthetic resin entirely on the topside and on the underside. Thus the fabric is embedded within the resin. A suitable fabric is, for example, a woven fabric of polyester fibers with a thread thickness of 1100 dtex (i.e. decitex which equals the weight in grams of 10 km. of yarn) and a thread density of 6 × 6 (warp, woof), wherein the reinforcing strips 11 are produced by the insertion or incorporation by weaving of additional threads with the same thread thickness and a reduced thread spacing. The mutual spacing of the reinforced strips 11 depends on the field of application for the sealing sheet and the types of mounting used, wherein for example a spacing of respectively 50 cm. normally corresponds to the requirements on the building site. In FIG. 2, a fabric 1 is illustrated which is provided with reinforcing strips 11 and 12 in two mutually perpendicular directions. In FIG. 3, a cross-sectional view shows the embedding of the fabric 1 in the thermoplastic sealing sheet, wherein the fabric-reinforced thermoplastic sealing sheet 2 is composed of the cover layer 21 and the bottom layer 22. This layer on both sides of the fabric can consist, for example, of soft PVC applied by the spread-coating method. The thickness of the layers 21, 22 depends on the requirements and can be different for each layer; the total thickness of the fabric-reinforced sealing sheet 2 depends likewise on the fields of application (use) and ranges normally between 1.0 and 2.5 mm. However, other dimensions as required can likewise be provided when using the present invention.

To mark the location of the reinforcing strips 11 and 12, respectively, in the sealing sheet 2, it is either possible to arrange such thick reinforcing strips that they cause a profile on the surface, or a discoloration of the thermoplastic layers 21 and/or 22 can be caused by a corresponding preparation of the threads. In FIG. 4, an example is illustrated wherein the fabric reinforced thermoplastic sealing sheet 2 is loosely laid on a wooden form 3 made of boards forming the cover for a roof. In the zone of the reinforcing strips 11, 12, preferably in the points of intersection thereof, the thermoplastic sealing sheet 2 is attached, for example, by means of the nails 4 to the substructure provided by the wooden form 3, wherein the mounting points are again closed off leakproof with the use of sealing patches of the same material as the cover layer of the thermoplastic sealing sheet by means of welding or cementing. It is likewise possible to employ additionally shims or the like in the mounting of the nails, to obtain an improved load distribution. In the example shown herein, it is advantageous to equip only the cover layer 21 of the thermoplastic sealing sheet 2, which faces the weather side, additionally with stabilizers to obtain a corresponding weatherability, while the bottom layer 22 need not contain such relatively expensive stabilizers against ultraviolet light, etc. It is also possible to incorporate into the thermoplastic sealing sheet 2, additionally to the fabric insert 1 fashioned with the reinforcing strips 11, 12, a fire-protection layer made of asbestos papers or asbestos mats, e.g. asbestos mats impregnated with chloroprene, not shown herein, between the cover layer 21 and the fabric 1.

The spot-like mounting of the sealing sheet to a substructure, which is shown in FIG. 4 by way of example in connection with a leakproof roof covering, is utilized in many instances also in tunnel construction; in addition to this spot-like mounting, a strip-like mounting can also be provided. The sealing sheet of this invention, equipped with reinforcing strips in a reinforcing fabric, can be utilized especially advantageously for all of these fields of application for loosely laid sealing sheets which must subsequently be attached to a foundation.

The PVC plastisols employed do not contain a curing agent, but rather are hardened (cured) exclusively by adding heat (gelling). One example for a PVC plastisol consists of:

- 64 parts by weight of PVC having a K-value of 70
- 36 parts by weight of plasticizer, e.g. di-$C_6$–$C_{11}$-phthalate
- 4 parts by weight of epoxide plasticizer
- 10 parts by weight of titanium dioxide as a filler and, depending on circumstances,
- 2 parts by weight of barium-cadmium-zinc stabilizer and
- 0.3 parts by weight of benzotriazone or benzophenone, respectively.

The sealing sheets of this invention will be further understood from the following example.

A soft polyvinyl chloride plastisol comprised of the following ingredients: 64 wt. % polyvinyl chloride of a K-value of 70; 36 wt. % of a plasticizer, i.e. di-$C_6$–$C_{11}$-phthalate and 10 wt. % of a filler, i.e. titanium dioxide; is applied to an endless carrier band at a temperature of 20° C. to produce a layer of liquid plastisol having a thickness of 1.5 mm and a width of 2000 mm. Subsequently, a reinforcing fabric of polyester fibers with a thread thickness of 1100 dtex and a thread density of 3 × 3 thread/cm$^2$ is laid on the liquid polyvinyl chloride plastisol. This reinforcing fabric has a plurality of spaced fabric-reinforcing strips which are 50 cm wide and which extend parallel to each other. Each of these strips are formed of threads of polyester having a thread thickness of 1100 dtex and are interwoven with the reinforcing fabric to provide a strip having a thread density of 6 × 6 thread/cm$^2$. Subsequently, another soft polyvinyl chloride containing 2.3 wt. % of a stabilizer and 0 wt. % of a filler in addition to the ingredients found in the initially applied polyvinyl chloride plastisol is applied to the fabric. Then the resulting composite is cured at a temperature of 180° C. for 2 minutes.

Upon evaluation of this fabric-reinforced sealing sheet it was found to have a tear-resistance of 1200 N/5 cm. as contrasted with a sheet which did not have the reinforcing strips provided therein which had a tear-resistance of 900 N/5 cm.

What is claimed is:

1. A fabric-reinforced multi-layered sealing sheet of a thermoplastic synthetic resin for large-area sealing purposes in structures within building construction, underground construction, and civil engineering construction, by use of a spot-like or strip-shaped mounting to the structures, which comprises an upper layer of thermoplastic synthetic resin, a lower layer of thermoplastic synthetic resin and a reinforcing fabric embedded therein between said layers, said fabric being provided at spaced intervals with fabric-reinforcing strips extending in one direction or in two mutually perpendicular directions, the upper layer that is to be exposed to weathering conditions containing stabilizers for said thermoplastic synthetic resin and having a higher weathering stability than the lower layer of thermoplastic synthetic resin.

2. The sealing sheet according to claim 1, wherein the fabric-reinforcing strips are formed by a denser thread arrangement and/or by thicker threads of the same material or of a material different from the basic material making up the reinforcing fabric.

3. The sealing sheet according to claim 1, wherein the fabric-reinforcing strips are formed by separate bands of the same material or of a material different from the basic material of the reinforcing fabric.

4. The sealing sheet according to claim 1, wherein the reinforcing fabric consists of mineral fibers, in the form of endless fibers or staple fibers.

5. The sealing sheet according to claim 4, wherein the mineral fibers are glass fibers.

6. The sealing sheet according to claim 1, wherein the fabric consists of a synthetic netting made of threads or filaments of polyester, polyamide, polyethylene, polypropylene or polycarbonate.

7. A sealing sheet according to claim 6, wherein the fabric-reinforcing strips are made of mineral fibers, glass fibers, synthetic threads of polyester, polyamide, polyethylene, polypropylene, polycarbonate, or of wires or strips of a metal.

8. The sealing sheet according to claim 7, wherein the layers encompassing the fabric are formed from soft PVC composition the upper layer having a differing composition as to the content of stabilizers and filler.

9. The sealing sheet according to claim 8, wherein the PVC composition is a cured plastisol.

10. The sealing sheet according to claim 7, wherein the thermoplastic synthetic resin of each layer is PVC, polyisobutylene or butyl rubber.

11. A sealing sheet according to claim 1, characterized in that the fabric is completely embedded between two thermoplastic synthetic resin layers.

12. The sealing sheet according to claim 1, wherein fabric-free zones are provided along the lateral margins of said sheet.

13. The sealing sheet according to claim 1, comprises as a further insert, a fire-protection layer incorporated in the resin matrix together with the fabric.

14. The sealing sheet according to claim 13, wherein the fire-protection layer is made of asbestos.

15. The sealing sheet according to claim 1, wherein the position of the reinforcing strips is made optically visible at least on the upper surface of the sealing sheet which provides the weather side.

16. The sealing sheet according to claim 1, wherein the upper layer of thermoplastic synthetic resin contains a higher proportion of the stabilizer for increasing weather stability and a lower proportion of filler than the lower layer of thermoplastic synthetic resin.

17. The sealing sheet according to claim 16, wherein the resin in the upper and lower layer is a soft PVC plastisol, the stabilizer is selected from a group consisting of benzotriazone, benzophenone, and barium-cadmium-zinc complexes, the filler is titanium dioxide and the reinforcing fiber is formed of woven polyester threads.

18. The sealing sheet according to claim 1, wherein the fabric reinforcing strips comprises strip-shaped portions of the reinforcing fabric that have a higher load bearing capacity than the remaining portion of the fabric.

* * * * *